US006310530B1

(12) United States Patent
Jacobus

(10) Patent No.: US 6,310,530 B1
(45) Date of Patent: Oct. 30, 2001

(54) DEVICE FOR EMERGENCY HAND OPERATION WITH SWITCHING MAGNETS

(75) Inventor: Heinz Jacobus, Dudweiler (DE)

(73) Assignee: Hydac Electronic GmbH, Saarbrucken (DE)

( * ) Notice: Subject to any disclaimer, the term of this patent is extended or adjusted under 35 U.S.C. 154(b) by 0 days.

(21) Appl. No.: 09/600,300

(22) PCT Filed: Oct. 1, 1998

(86) PCT No.: PCT/EP98/06259

§ 371 Date: Jul. 14, 2000

§ 102(e) Date: Jul. 14, 2000

(87) PCT Pub. No.: WO99/36926

PCT Pub. Date: Jul. 22, 1999

(30) Foreign Application Priority Data

Jan. 15, 1998 (DE) ..... 198 01 201

(51) Int. Cl.[7] ..... H01F 7/08
(52) U.S. Cl. ..... 335/238; 335/258; 335/273
(58) Field of Search ..... 335/238, 255, 335/258, 273; 251/129.02, 129.03, 129.18

(56) References Cited

U.S. PATENT DOCUMENTS 3,900,810 8/1975 Grenier ..... 335/239
4,544,128 * 10/1985 Kolchinsky et al. ..... 251/30.01
4,871,989 10/1989 Gross ..... 335/164
5,271,599 * 12/1993 Kolchinsky et al. ..... 251/30.04
5,842,679 * 12/1998 Kolchinsky ..... 251/30.04

FOREIGN PATENT DOCUMENTS 32 43 999 5/1984 (DE) .
33 17 226 11/1984 (DE) .
92 00 549 3/1992 (DE) .
0 242 557 10/1987 (EP) .

* cited by examiner

*Primary Examiner*—Ramon M. Barrera
(74) *Attorney, Agent, or Firm*—Roylance, Abrams, Berdo & Goodman, L.L.P.

(57) ABSTRACT

A device for emergency hand operation has switching magnets with an armature that can be moved in the pole pipe to a final position by the force of a spring assembly, and can be moved against the spring force to a second final position by a magnetic field excitation. The device has a tensional member which can be axially displaced and moved by a manual actuating device. A carrier interacts with the armature to move the carrier against the spring force and to the second final position. The armature, the pole core, the spring assembly, the tensional member and the actuating device are combined to form a prefabricated component which can be inserted into the pole pipe via its inner open end and which can be connected to the pole pipe.

16 Claims, 3 Drawing Sheets

DEVICE FOR EMERGENCY HAND OPERATION WITH SWITCHING MAGNETS

FIELD OF THE INVENTION

The present invention relates to a device for emergency hand operation with switching magnets. The armature can be moved in the pole pipe into one final position by the force of a spring assembly and can be moved into a second final position by magnetic field excitation against the force of the spring assembly. A tensioning member is axially slidable in the pole core, can be moved by means of a manual actuating device, and has a carrier cooperating with the armature to move the armature counter to the force of the spring into its second final position.

BACKGROUND OF THE INVENTION

Devices, known as "tensioning" switching magnets, serve as security devices which facilitate manual engagement when, for example, during breakdown of the magnetic field excitation or during a mechanical blockade despite magnetic field excitation, no movement of the armature occurs counter to the effective spring force. The ability to manually move the armature in such events is particularly advantageous, especially when the relevant switching magnet serves in hydraulic installations for the actuation of a multi-way valve for the control of the pressure oil supply, for instance, for use in a press or in a working cylinder. In such environments, it is essential to avoid danger, so that in emergency situations the pressure oil supply can be retained manually.

Known devices of this type, as disclosed in DE 33 17 226 A1, have complicated constructions and have relatively great numbers of individual component parts. Another drawback resides in that because of the great number of individual parts and because of the conditions under which the pole pipe must be mounted with construction of devices on both sides, a higher cost of assembly occurs.

SUMMARY OF THE INVENTION

Objects of the present invention are to provide a device for the emergency manual operation, which is a considerable improvement over known devices because of simpler construction and considerably lower outlay for its assembly.

With the device according to the present invention these objects are attained by the armature, the pole core, the spring assembly, the tensioning member and the actuating device being combined in the form of a modular unit. That modular unit can be inserted into the pole pipe through its inner open end and can be connected with the pole pipe.

Both the operational elements for the emergency hand operation and the spring assembly effecting the armature are integrated into the pole core. On the one hand, a compact structure is obtained with as small as possible number of individual component parts. The armature cooperating with the tensioning member likewise is a component part of the prefabricated structural unit. On the other hand, the advantage of simplified assembly is obtained, because the structural unit need be inserted from only one open end into the pole pipe.

The connection with the pole pipe in this case is of particularly simple construction, when the pole core has an annular groove worked into its periphery and can be connected by rolling or folding the end of the pole pipe into the annular groove flange-like or bead-like therewith.

With one preferred exemplary embodiment, the operating device can have a threaded bolt as settling member for the axial slide movement of the tensioning member. The bolt cooperates with an interior threaded segment of an axial bore in the pole core forming a guide for the tensioning member.

With such an embodiment, the emergency operation can occur in a convenient and secure manner by manual revolution of the threaded bolt. This bolt can have a screw head accessible at the open end of the pole core, which, for example, can be provided with peripheral milling or beading.

Preferably, the tensioning member is configured as a one-piece extension of the threaded bolt. The bolt extends through the inner end of the pole core outward into an axial bore embodied in the armature.

Preferably, the extension of the threaded bolt forming the tensioning member, which extends through a sealing arrangement found in the axial bore of the pole core, passes through into the axial bore embodied in the armature, and has a tapered outside diameter as compared with the other and proximate part of the threaded bolt. Thus, an emergency operation can also be easily executed against high working pressures which are being generated.

The assembly is particularly simple if a milled or beaded edge is provided and formed facing outward in the free or open end of the extension of the tensioning member. Such a construction of the free or open end of the tensioning member can be produced particularly simply during the assembly, if the free end of the tensioning member has an axial pocket construction. Following the assembly of the individual component parts of the modular unit-like structural unit, the opening of the pocket construction is formed as a milled or beaded folded back edge opening outward.

Other objects, advantages and salient features of the present invention will become apparent from the following detailed description, which, taken in conjunction with the annexed drawings, discloses a preferred embodiment of the present invention.

BRIEF DESCRIPTION OF THE INVENTION

Referring to the drawings which form a part of this disclosure:

DETAILED OF THE INVENTION

Figure 1:
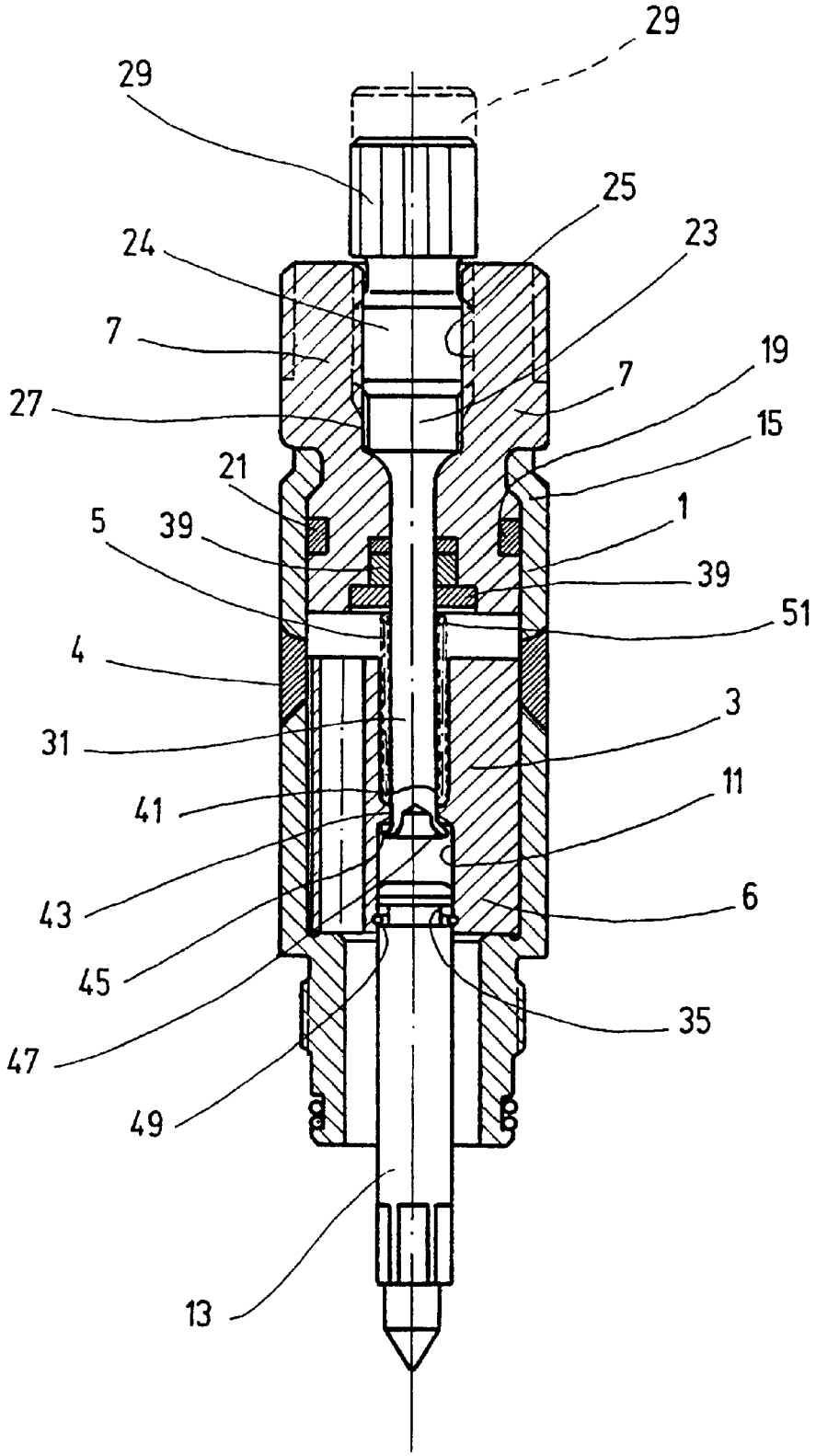
FIG. 1 is a side elevational view in section of a switching magnet for emergency manual operation, without the magnetic coil, according to an embodiment of the present invention.
Figure 2:
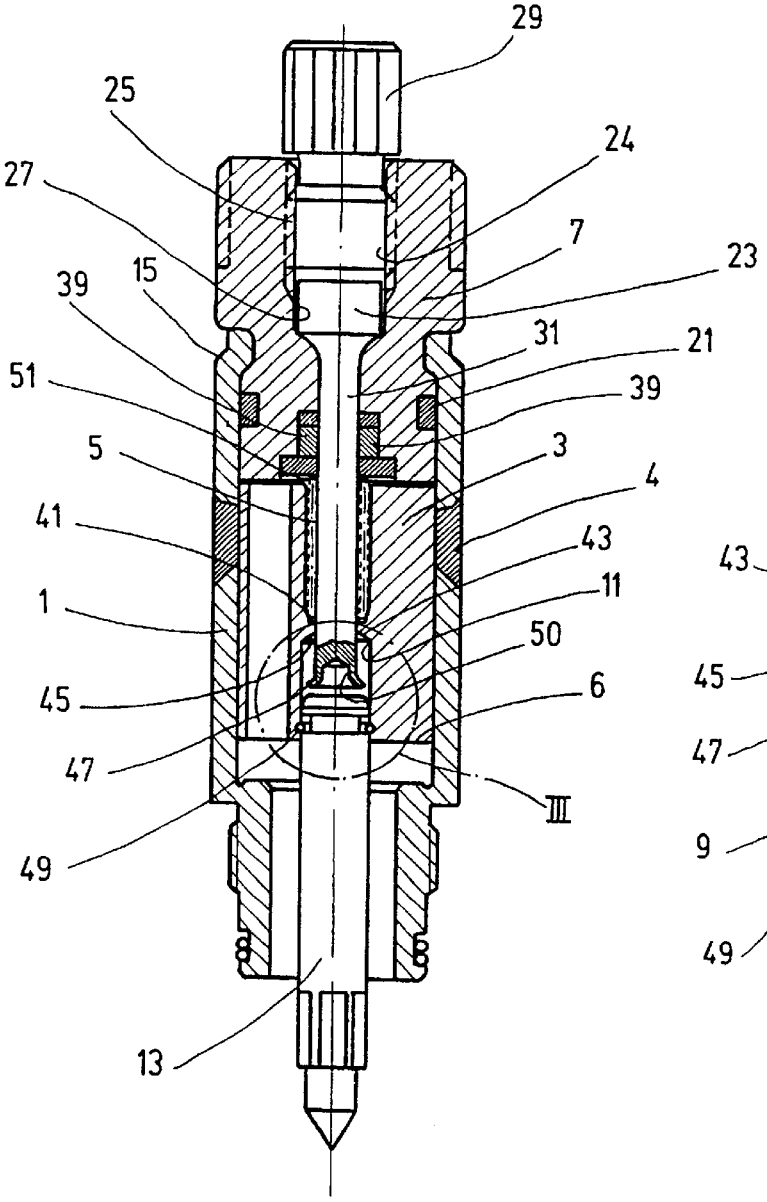
FIG. 2 is a side elevational view in section of the switching magnet of FIG. 1 with its armature drawn back proximate to the pole core.

The essential parts of a switching magnet are represented in FIGS. 1 and 2. The magnetic coil resting on its pole pipe 1 is omitted in the drawing. The magnet is a "tensioning" type magnet. The magnet armature 3 is pressed or biased by means of a spring assembly 5 away from the pole core 7 and into a final position, shown in FIG. 1. Upon excitation of the magnetic coil, armature 3 is pushed against the force of spring assembly 5 toward pole core 7, as is shown in FIG. 2. Pole pipe 1 is sectioned or split in two parts be a welding 4 for the magnetic uncoupling.

On its end area 6 more distant or remote from pole core 7, armature 3 is contiguous with a spring ring or spring washer 49, resting in an annular groove 9 formed in an axial bore 11 in armature 3. The armature is connected with an operational tapered mandrel 13, see particularly FIG. 3. For the cooperation with spring ring or washer ring 49, operational tapered mandrel 13 likewise has an annular groove 35, and extends away from armature 3 outward beyond the proximate end of pole pipe 1. Operational tapered mandrel 13 serves as operating member for a related switching process, for example, for valve actuation in a hydraulic system.

Figure 4:
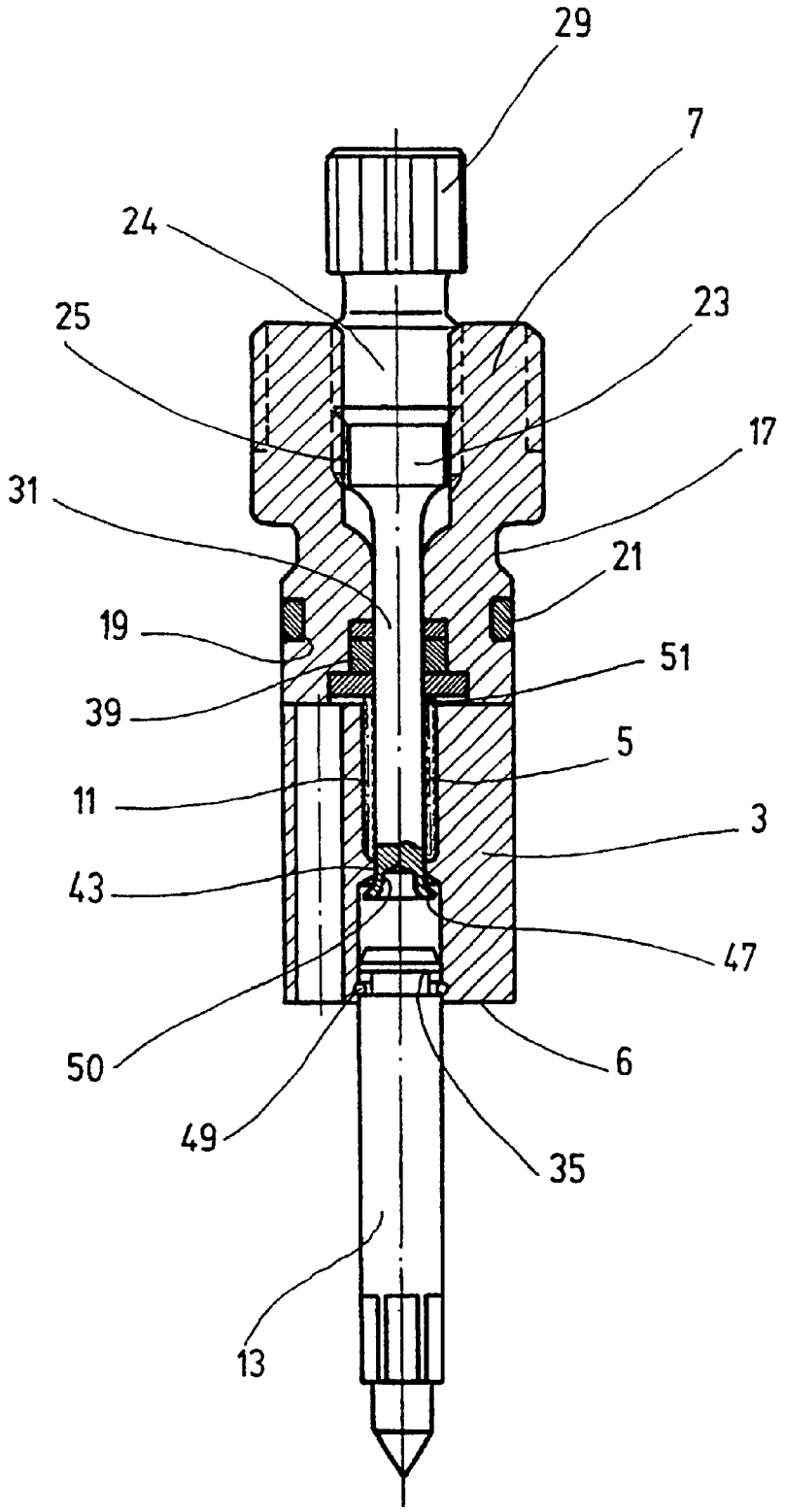
FIG. 4 is a side elevational view in section of the modular unit of the pole core, armature and individual components cooperating with them of the switching magnet of FIGS. 1 and 2, before assembly into the associated pole pipe.

Individual component parts are held collectively in the interior of pole pipe 1, and form a prefabricated, modular unit-like structural unit, which is illustrated in its entirety in FIG. 4. This modular unit is inserted via the open end 15 of pole pipe 1 into the pole pipe. In this manner, pole core 7 closes off pole pipe 1 at the end 15. The connection between pole pipe 1 and pole core 7 occurs by folding end 15 of pole pipe 1 into a peripheral annular groove 17 of pole core 7. Another peripheral annular groove 19 in pole core 7 receives an 0-ring 21 for sealing between pole core 7 and pole pipe 1.

In addition to pole core 7, armature 3, operating mandrel 13 and spring assembly 5 mounted therein, the modular unit shown in FIG. 4 also includes a device for the emergency hand or manual operation. This device includes a threaded bolt 23. The threaded bolt segment 24 is screwed together with an interior threading 25 in an axial bore 27 in pole core 7. The bolt has a screw head 29 accessible at the end of pole core 7. The screw head is provided with milling or beading on the edge for the manual revolution operation.

Figure 3:
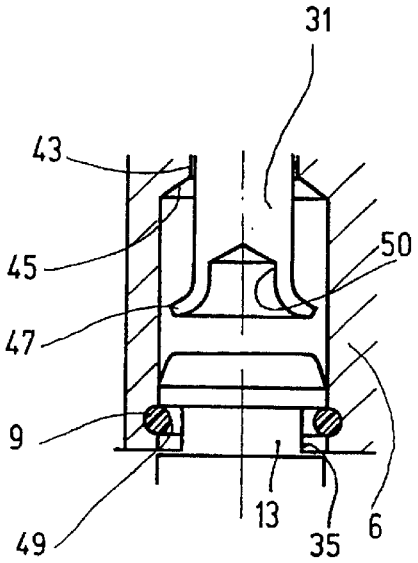
FIG. 3 is a partial side elevational view in section of area III of the switching magnet of FIG. 2, in larger scale.

Threaded bolt 23 is extended on its end more distant or remote from screw head 29, embodied by a tapered end segment or extension 31, extending into axial bore 11 of armature 3 through a sealing arrangement 39 arranged in another segment of the bore 27 of the pole core. The free end of extension 31 extends through a local narrowing point 43, passing through the first annular shoulder surface 41 facing pole core 7 in bore 11 and a second annular shoulder surface 45 more distant from pole core 7. Surface 45 is illustrated most clearly in FIG. 3. The free end of extension 31 has a pocket opening 50 coaxial to the end. The opening is flanged or milled outward for the formation of a milled or beaded edge 47. As illustrated in FIGS. 2 and 3, the milled, flanged edge 47 forms a carrier. In the case of an emergency operation, in other words with a screwing out of screw bolt 23, as shown in phantom lines in FIG. 1, the annular shoulder surface 45 of the local narrowing 43 of bore 1 of armature 3 engages the carrier to apply force on the armature against the force or bias of spring assembly 5 to move the armature against pole core 7. This particular arrangement or positioning of the individual component parts is shown in FIG. 4.

The length of the tensioning member is to be such that when the screw bolt is screwed in, in other words when the emergency hand operation is not activated, the milled or beaded terminal edge 47 of extension 31, as in FIGS. 1 to 3, is found positioned relative to or spaced from annular shoulder surface 45 that the standard power stroke or working lift of armature 3 is possible without hindrance.

As can be seen in the drawings, compression spring assembly 5 in axial bore 11 or armature 3 on the one hand is supported on annular shoulder surface 41 turned toward pole core 7 and formed by narrowing point 43. The other spring assembly end is supported on an annular disk or washer 51 engaging the sealing arrangement 39 in pole core 7.

With this arrangement, the screwing out of threaded bolt 23 causes armature 3 to be moved counter to the spring force or bias of spring assembly 5 into a final position proximate to pole core 7. In other words, it causes an emergency hand or manual operation to be required when armature 3, because of any sort of disturbance, is not movable by magnetic field excitation counter to the force of spring assembly 5. In FIG. 1, the component parts are represented in the position taken without magnetic field excitation and without activated emergency hand operation, whereby armature 3 under influence of the force of spring assembly 5 has moved downward, as shown in the drawing, and threaded blot 23 is screwed into pole core 7. As a result of this, milled or beaded edge 47 is located in the vicinity of annular shoulder surface 45 of bore 11 of armature 3. With armature 3 being drawn by magnetic field excitation to pole core 7, as in FIGS. 2 and 3, milled or beaded edge 47 is at a certain spacing from annular shoulder surface 45 corresponding to the power stroke or degree of working lift of armature 3.

While a particular embodiment has been chosen to illustrate the invention, it will be understood by those skilled in the art that various changes and modifications can be made therein without departing from the scope of the invention as defined in the appended claims.

What is claimed is:

1. A device for emergency hand operation of switching magnets, comprising:

a pole pipe having an inner open end;

an armature movably mounted in said pole pipe from a first position to a second position by magnetic field excitation;

a spring assembly biasing said armature toward said first position;

a pole core having an axial bore with an internal thread and having a first annular peripheral groove, said open end of said pole pipe being folded into said first peripheral groove to connect said pole core and said pole pipe;

a tensioning member axially slidable and guided in said axial bore of said pole core and having a carrier cooperating with said armature to move said armature therewith counter to biasing of said spring assembly, said tensioning member extending through an inner end of said pole core and into an axial bore of said armature; and a manual actuating threaded bolt axially fixed to said tensioning member to move same axially in said pole core and threadedly engaged with said internal thread, said tensioning member being configured as a one-piece extension of said threaded bolt;

said armature, said pole core, said spring assembly, said tensioning member and said actuating threaded bolt being combined in a single prefabricated structural unit inserted into said open end.

2. A device according to claim 1 wherein said pole core comprises a second peripheral groove receiving an O-ring forming a seal with an inner wall of said pole pipe.

3. A device according to claim 1 wherein said threaded bolt comprises a screw head accessible on a free end of said pole core for manual rotationary operation.

4. A device according to claim 1 wherein said extension of said threaded bolt comprises a transverse diameter tapering in a direction away from threading on said threaded bolt; and said pole core comprises a seal in said axial bore thereof sealing said tensioning member from an unthreaded inner wall of said axial bore of said pole core.

5. A device according to claim 4 wherein said axial bore in said armature comprises a local narrowing forming a first annular shoulder surface facing said pole core; and said spring assembly is arranged on said tensioning member and is compressed between said first annular shoulder surface and said pole core.

6. A device for emergency hand operation of switching magnets, comprising:

a pole pipe;

an armature movably mounted in said pole pipe from a first position to a second position by magnetic field excitation;

a spring assembly biasing said armature toward said first position;

a pole core having an axial bore with an internal thread and having a first annular peripheral groove, said open end of said pole pipe being folded into said first peripheral groove to connect said pole core and said pole pipe;

a tensioning member axially slidable and guided in said axial bore of said pole core and having a carrier cooperating with said armature to move said armature therewith counter to biasing of said spring assembly, said tensioning member extending through an inner end of said pole core and into an axial bore of said armature; and a manual actuating threaded bolt axially fixed to said tensioning member to move same axially in said pole core and threadedly engaged with said internal thread, said tensioning member being configured as a one-piece extension of said threaded bolt.

7. A device according to claim 6 wherein said pole core comprises a second peripheral groove receiving an O-ring forming a seal with an inner wall of said pole pipe.

8. A device according to claim 6 wherein said threaded bolt comprises a screw head accessible on a free end of said pole core for manual rotationary operation.

9. A device according to claim 6 wherein said extension of said threaded bolt comprises a transverse diameter tapering in a direction away from threading on said threaded bolt; and said pole core comprises a seal in said axial bore thereof sealing said tensioning member from an unthreaded inner wall of said axial bore of said pole core.

10. A device according to claim 9 wherein said axial bore in said armature comprises a local narrowing forming a first annular shoulder surface facing said pole core; and said spring assembly is arranged on said tensioning member and is compressed between said first annular shoulder surface and said pole core.

11. A device for emergency hand operation of switching magnets, comprising:

a pole pipe having an inner open end;

an armature movably mounted in said pole pipe from a first position to a second position by magnetic field excitation;

a spring assembly biasing said armature toward said first position;

a pole core having an axial bore with an internal thread and being coupled to said pole pipe;

a tensioning member axially slidable and guided in said axial bore of said pole core and having a carrier cooperating with said armature to move said armature therewith counter to biasing of said spring assembly; and a manual actuating threaded bolt axially fixed to said tensioning member to move same axially in said pole core and threadedly engaged with said internal thread, said tensioning member being configured as a one-piece extension of said threaded bolt and extending through an inner end of said pole core and into an axial bore in said armature.

12. A device according to claim 11 wherein said armature, said pole core, said spring assembly, said tensioning member and said actuating threaded bolt are combined in a single prefabricated structural unit inserted into said open end.

13. A device according to claim 11 wherein said pole core comprises a second peripheral groove receiving an O-ring forming a seal with an inner wall of said pole pipe.

14. A device according to claim 11 wherein said threaded bolt comprises a screw head accessible on a free end of said pole core for manual rotationary operation.

15. A device according to claim 11 wherein said extension of said threaded bolt comprises a transverse diameter tapering in a direction away from threading on said threaded bolt; and said pole core comprises a seal in said axial bore thereof sealing said tensioning member from an unthreaded inner wall of said axial bore of said pole core.

16. A device according to claim 15 wherein said axial bore in said armature comprises a local narrowing forming a first annular shoulder surface facing said pole core; and said spring assembly is arranged on said tensioning member and is compressed between said first annular shoulder surface and said pole core.

* * * * *